US012042842B2

(12) United States Patent
Wilhelm et al.

(10) Patent No.: US 12,042,842 B2
(45) Date of Patent: Jul. 23, 2024

(54) TOOL AND METHOD FOR PROCESSING PLATE-SHAPED WORKPIECES

(71) Applicant: TRUMPF Werkzeugmaschinen SE + Co. KG, Ditzingen (DE)

(72) Inventors: Markus Wilhelm, Gerlingen (DE); Takeshi Abiko, Ditzingen (DE)

(73) Assignee: TRUMPF Werkzeugmaschinen SE + Co. KG, Ditziingen (DE)

( * ) Notice: Subject to any disclaimer, the term of this patent is extended or adjusted under 35 U.S.C. 154(b) by 0 days.

(21) Appl. No.: 17/582,187

(22) Filed: Jan. 24, 2022

(65) Prior Publication Data

US 2022/0143665 A1 May 12, 2022

Related U.S. Application Data

(63) Continuation of application No. PCT/EP2020/070473, filed on Jul. 20, 2020.

(30) Foreign Application Priority Data

Jul. 23, 2019 (DE) ..... 10 2019 119 849.6

(51) Int. Cl.
*B21D 28/12* (2006.01)
*B21D 5/04* (2006.01)

(52) U.S. Cl.
CPC ..... *B21D 5/045* (2013.01); *B21D 28/12* (2013.01)

(58) Field of Classification Search
CPC ..... B21D 5/045; B21D 28/12; B21D 28/36; B21D 28/343; B21D 28/265
See application file for complete search history.

(56) References Cited

U.S. PATENT DOCUMENTS 9,839,952 B2 12/2017 Kraft
2006/0027626 A1* 2/2006 Endo ..... B21D 5/01 228/101
2019/0299272 A1 10/2019 Ockenfuss et al.

FOREIGN PATENT DOCUMENTS

DE 102016119435 A1 4/2018
EP 2794142 A1 10/2014
EP 3085466 A1 10/2016
GB 2033788 A 5/1980
JP H07164058 A 6/1995
(Continued)

OTHER PUBLICATIONS

Machine Translation of WO2018/055190A1 (Year: 2018).*
Machine Translation of JP2007253225A (Year: 2007).*

*Primary Examiner* — Debra M Sullivan
(74) *Attorney, Agent, or Firm* — Laurence A. Greenberg; Werner H. Stemer; Ralph E. Locher

(57) ABSTRACT

A tool and a method for processing plate-shaped workpieces, in particular metal sheets. An upper tool and a lower tool are movable toward one another for processing a workpiece arranged in between. The upper tool has a clamping shank and a main body arranged on a common position axis. A processing tool is arranged on a main body so as to be situated opposite the clamping shank. The lower tool has a main body with a bearing surface for the workpiece and an opening within the bearing surface. The processing tool of the upper tool has at least one bending edge and at least one cutting edge, and the main body of the lower tool has at least one counterpart bending edge and at least one counterpart cutting edge.

19 Claims, 7 Drawing Sheets

(56) References Cited

FOREIGN PATENT DOCUMENTS

| | | | |
|---|---|---|---|
| JP | 2000153321 | A | 6/2000 |
| JP | 2007253225 | A | 10/2007 |
| WO | 0243892 | A2 | 6/2002 |
| WO | 2011148393 | A1 | 12/2011 |
| WO | 2018055190 | A1 | 3/2018 |

* cited by examiner

TOOL AND METHOD FOR PROCESSING PLATE-SHAPED WORKPIECES

CROSS-REFERENCE TO RELATED APPLICATION

This application is a continuation, under 35 U.S.C. § 120, of copending International Patent Application PCT/EP2020/070473, filed Jul. 20, 2020, which designated the United States; this application also claims the priority, under 35 U.S.C. § 119, of German Patent Application DE 10 2019 119 849.6, filed Jul. 23, 2019; the prior applications are herewith incorporated by reference in their entirety.

FIELD AND BACKGROUND OF THE INVENTION

The invention relates to a tool and to a method for processing plate-like or plate-shaped workpieces, in particular metal sheets.

A machine tool is known from our commonly assigned German published patent application DE 10 2016 119 435 A1. The machine tool processes plate-shaped workpieces, in particular metal sheets. The tools are actuated by the machine tool for the purposes of stamping and punching. The tool comprises an upper tool, which is movable by means of a stroke drive apparatus along a stroke axis in the direction of a workpiece for processing and in the opposite direction and is displaceable by means of a drive arrangement along the upper positioning axis. Furthermore, a lower tool is provided which is aligned with the upper tool and which is movable by means of a stroke drive apparatus along a lower stroke axis in the direction of the upper tool and is positionable along a lower positioning axis which is oriented perpendicular to the position axis of the upper tool. The drive arrangements are actuated, in order to move the upper and lower tool, by means of a controller. The upper tool comprises a processing tool that is inclined relative to a positioning axis of the upper tool. Two cutting edges oriented parallel to one another are provided on the processing tool in order, for example, to cut a sheet-metal tab that has been bent up at an angle or to produce a side surface oriented obliquely with respect to the plane of the plate-like workpiece.

Japanese published patent application JP 2000-153 321 A1 furthermore discloses a tool for processing plate-like workpieces. An upper tool comprises a processing tool with an obliquely running cutting edge. The lower tool comprises an opening, wherein a counterpart cutting edge offset downwardly relative to a bearing surface is provided in the opening. During a working stroke of the upper tool relative to the lower tool, a cutting process firstly occurs at the leading cutting edge of the processing tool. A tab is cut out and bent and, during a further cutting stroke, is cut off at the cutting edge that lies in the opening of the lower tool. Bending and punching take place in one stroke, wherein the processed workpiece remains on the plate-like workpiece.

International patent application publication WO 2011/148393 A1 and its counterpart US 2013/0061728 A1 disclose a punching and bending tool in the case of which, in a working stroke during which the upper tool is moved toward the lower tool, the plate-like material is firstly punched out and, during the further punching processing operation, simultaneous bending of the workpiece occurs.

SUMMARY OF THE INVENTION

It is accordingly an object of the invention to provide a tool and a processing method which overcome a variety of disadvantages of the heretofore-known devices and methods of this general type and which provides for the processing of plate-like workpieces with increased flexibility.

With the above and other objects in view there is provided, in accordance with the invention, a tool for processing plate-shaped workpieces, such as sheet metal, the tool comprising:

- an upper tool and a lower tool movably disposed toward one another for processing a workpiece arranged in between the upper and lower tools;
- the upper tool having a clamping shank and a main body, arranged on a common position axis, and a processing tool mounted to the main body opposite the clamping shank;
- the lower tool having a main body with a bearing surface for the workpiece and an opening formed within the bearing surface;
- the processing tool of the upper tool being formed with at least one bending edge and at least one cutting edge; and
- the main body of the lower tool being formed with at least one counterpart bending edge and at least one counterpart cutting edge.

In other words, the objects or the invention are achieved by means of a tool for processing plate-like workpieces, in the case of which a processing tool of the upper tool comprises at least one bending edge and at least one cutting edge, and the main body of the lower tool has at least one counterpart bending edge and at least one counterpart cutting edge. In this way, for example in a first processing step, a workpiece part, preferably in the form of a tab-like cut-out portion, can be processed by way of a bending stroke, wherein the degree of angular bending can be influenced in a manner dependent on the stroke movement between the upper tool and the lower tool. By means of one or more successive stroke movements, one or more angled bends can be introduced into the workpiece part. The same tool as that used for producing the angled bend or bend can be used for cutting off the workpiece part from the plate-like material. Here, the cutting edge of the upper tool and the counterpart cutting edge of the lower tool are aligned with one another, and the plate-like material is transferred into the cutting position, such that the workpiece part is subsequently cut from the plate-like workpiece by way of a cutting stroke. Here, the cut-off workpiece part may be a good part or a waste part. By means of this tool, a bending and punching processing operation can be made possible without a tool change simply by adjusting the position axes of the upper tool and lower tool and the assignment of the position axes of the upper tool and of the lower tool to one another.

The cutting edge and the bending edge are preferably formed separately from one another on the processing tool, preferably on the same processing tool. A relatively great bending width and limb width are thus obtained.

Furthermore, the cutting edge and the bending edge on the processing tool of the upper tool preferably run parallel to one another and are oriented perpendicular to the positioning axis. This allows straightforward implementation of individual positions of the upper tool relative to the lower tool for a bending and also a punching or cutting process.

The cutting edge and the bending edge on the processing tool of the upper tool preferably lie in the same plane and are configured so as to be perpendicular to the position axis. This also allows straightforward production of such a processing tool.

The cutting edge and the bending edge advantageously delimit a ram surface on the processing tool, which ram surface is preferably oriented perpendicular to the position axis. Support can thus be provided during the bending and punching processing operation.

Furthermore, the bending edge may be configured so as to run perpendicular to the position axis, and the cutting edge may be oriented so as to be inclined at an angle relative to the position axis. In this way, a cutting process can be implemented in which a workpiece part is completely cut from the plate-like material only with increasing plunging depth.

One advantageous configuration of the bending edge on the processing tool provides for an inclined surface to extend in the direction of the main body proceeding from the bending edge, which inclined surface is inclined toward the position axis. The inclined surface is preferably oriented at an angle of less than 90° with respect to the ram surface of the processing tool. A bending edge with an undercut can be formed in this way. The bending edge allows overbending after the workpiece part has been bent at an angle of 90°, for example in order to compensate for a spring-back effect, such that a 90° angled bend is attained after the spring-back effect that has occurred.

One advantageous embodiment of the tool provides for the bending edge and the cutting edge on the upper tool to be aligned within a projection area which is formed perpendicular to the position axis and, as viewed in the stroke direction, by the main body. Alternatively, provision may be made for at least the bending edge or the cutting edge of the upper tool to lie outside the projection area which is formed perpendicular to the position axis and, as viewed in the stroke direction, by the main body. In the first embodiment, the height of the portion bent at an angle is determined by the spacing of the bending edge to the main body. In the second alternative embodiment, the height of the portion bent at an angle may be greater than the spacing between the bending edge and the main body, if the bending edge lies outside the projection area.

On the main body of the upper tool, there are preferably provided hold-down elements, between which the processing tool extends and relative to which the processing tool can be led out. The hold-down elements preferably extend, in terms of height, as far as the cutting and bending edge of the processing tool. Alternatively, the at least one hold-down element may extend beyond the bending edge and the cutting edge of the processing tool. In this way, the bending and cutting edges are set back in relation to an end surface of the hold-down elements. The length of the at least one hold-down element may extend at least partially along the cutting and/or bending edge. Preferably, the at least one hold-down element extends approximately or entirely along the length of the bending and/or cutting edge. The hold-down elements are preferably of elastically flexible form. The hold-down elements serve for securely positioning the plate-like workpiece on the bearing surface of the lower tool as the bending edge and counterpart bending edge are moved toward one another and at least partially moved past one another. An analogous situation applies, in the case of the cutting stroke, to the cutting edge and counterpart cutting edge of the upper tool and lower tool.

A further advantageous configuration of the tool provides for the counterpart bending edge and/or the counterpart cutting edge to be provided fixedly at the opening of the bearing surface of the main body of the lower tool. This allows a simple structural design. Alternatively, provision may be made for the counterpart bending edge and/or the counterpart cutting edge to be provided fixedly on the base body of the lower tool, wherein the opening of the bearing surface is positioned so as to adjoin and/or so as to be flush with the counterpart bending edge and/or counterpart cutting edge and is displaceable relative to the base body.

The at least one counterpart bending edge and/or the at least one counterpart cutting edge are provided in the opening of the bearing surface of the main body of the lower tool and/or so as to adjoin the bearing surface of the main body. If, for example, only relatively small workpieces are produced, it is advantageous if the at least one counterpart bending edge and the at least one counterpart cutting edge are provided in the opening of the bearing surface. In this way, the displacement movements between the upper tool and lower tool can be kept small. Workpiece parts that have been cut off can be discharged downwardly through the opening in the lower tool. If relatively large or relatively wide plate-like workpieces are to be processed, the counterpart bending edge and/or the counterpart cutting edge may be provided outside the bearing surface but so as to adjoin the latter in order to perform the processing operation. After a cutting stroke, the processed workpiece parts may be discharged via a discharge flap in a workpiece bearer of the machine tool.

With the above and other objects in view there is also provided, in accordance with the invention, a method for processing plate-like workpieces, in which method a tool according to any one of the embodiments described above is used, and a workpiece part of the plate-like workpiece, which may be in the form of a tab-like cut-out portion, is positioned relative to the bearing surface of the lower tool, and the bending edge on the upper tool and the counterpart bending edge on the lower tool are aligned with one another, and at least one bending stroke movement is effected during which the workpiece part is angled relative to the plate-like workpiece and during which the angled workpiece part and/or the cutting edge of the upper tool and the counterpart cutting edge of the lower tool are transferred into a cutting position in order to subsequently perform a cutting stroke by means of which the workpiece part is cut off. A rapid process sequence can thus be performed when bending and cutting a workpiece part to form the plate-like workpiece. Non-productive time for the changeover of the tool from a bending tool to a punching tool can thus be omitted. Owing to the reduced positioning of the deformed sheet-metal panel, the risk of scratches on the component and the jamming of the part are thus furthermore reduced.

Furthermore, it is preferable if the alignment of the bending edge or cutting edge of the upper tool with the counterpart bending edge or counterpart cutting edge of the lower tool is effected by means of a rotational movement and/or by means of a displacement direction along the upper and/or lower positioning axis. In particular, a displacement movement of the upper tool and/or lower tool in a Y direction is effected. A fast advancing movement and alignment of the upper tool and of the lower tool for the subsequent processing operation are thus possible.

A further advantageous configuration of the method provides that, during a bending stroke movement between the upper tool and the lower tool, a stroke movement along the stroke axes of the upper and lower tool is performed, or that a stroke movement that lies outside the stroke axis of the upper and lower tool is additionally superposed on the stroke movement along the stroke axes. The quality of the bending edge on the workpiece with regard to a visual appearance on the workpiece and overbending can be influenced in a manner dependent on the displacement movement.

In the case of a workpiece part for processing whose width is smaller than the opening in the bearing surface of the lower tool, a cutting position between the upper and lower tool is set such that a cutting edge of the upper tool is aligned with a counterpart cutting edge at the opening of the lower tool. In this way, after the cutting operation, a straightforward discharge downward through the lower tool is possible.

If the workpiece part for processing has a width that is larger than the opening in the bearing surface of the lower tool, a cutting position is set in the case of which the at least one cutting edge of the upper tool is aligned with a counterpart cutting edge on the lower tool, which counterpart cutting edge is provided outside the bearing surface. In this way, even relatively large workpieces can be processed using the same tool, which allows both bending and punching.

Provision is furthermore made whereby the cutting edge of the upper tool and the counterpart cutting edge of the lower tool are, for a cutting stroke, aligned with one another in a manner dependent on the respective material thickness of the workpiece part. This makes it possible for different material thicknesses to be processed in the same way using one and the same tool, and for a respective adjustment to be made possible in order to perform an optimum cutting stroke.

Provision is furthermore made whereby the bending edge of the upper tool and the counterpart bending edge of the lower tool are, for a bending stroke movement, aligned with one another in a manner dependent on the respective material thickness of the workpiece part. High bending quality can thus be achieved. Additionally, a wide variety of thicknesses of the workpiece parts can be processed in the same way using the same tool.

Other features which are considered as characteristic for the invention are set forth in the appended claims.

Although the invention is illustrated and described herein as embodied in a tool and a method for processing plate-shaped workpieces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
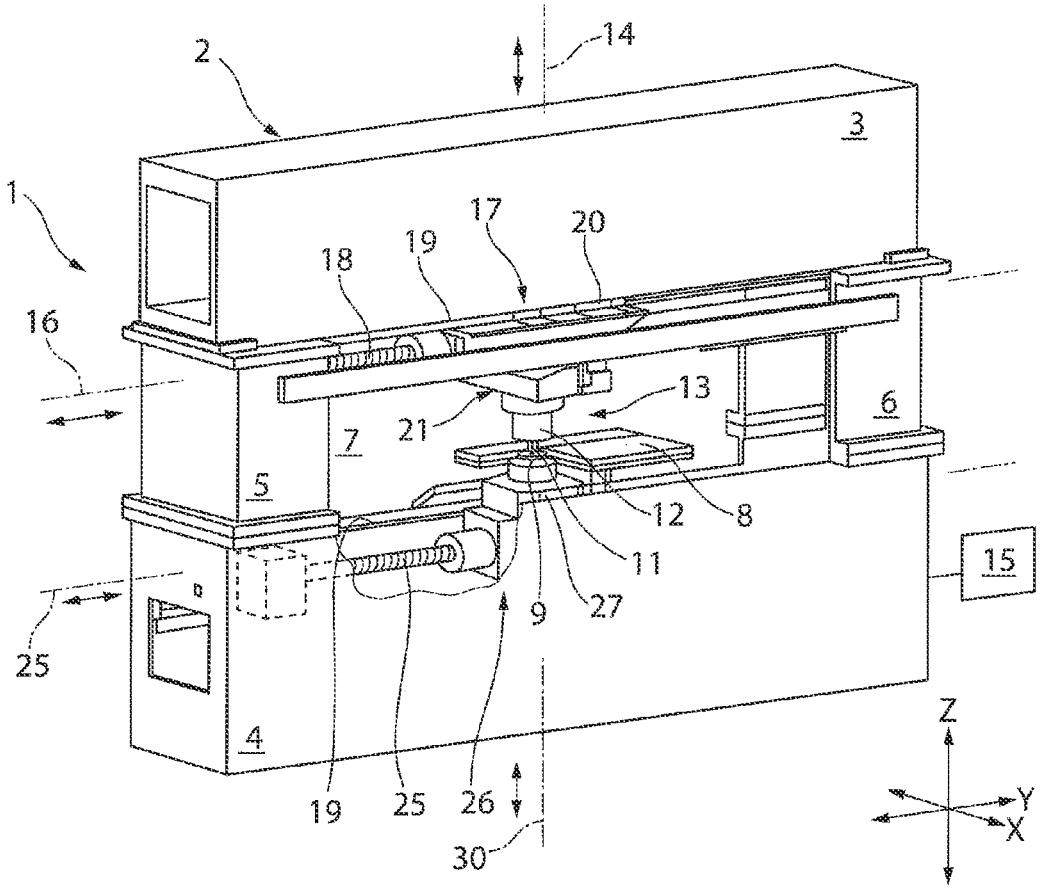
FIG. 1 shows a perspective view of a machine tool.

Referring now to the figures of the drawing in detail and first, in particular, to FIG. 1 thereof, there is shown a machine tool 1 that is configured as a punching and bending machine. The machine tool 1 comprises a load-bearing structure with a closed machine frame 2. The machine frame comprises two horizontal frame members 3, 4 and two vertical frame members 5 and 6. The machine frame 2 encloses a frame interior space 7, which forms the working region of the machine tool 1 with an upper tool 11 and a lower tool 9.

The machine tool 1 serves for the processing of plates, referred to as plate-shaped or plate-like workpieces 10, which for the sake of simplicity are not illustrated in FIG. 1, and which for processing purposes are arranged in the frame interior space 7. A workpiece 10 for processing is placed onto a workpiece support 8 that is provided in the frame interior space 7. The lower tool 9 is mounted, in an aperture of the workpiece support 8, on the lower horizontal frame member 4 of the machine frame 2.

The upper tool 11 is fixed in a tool receptacle at a lower end of a plunger 12. The plunger 12 is part of a stroke drive apparatus 13, by means of which the upper tool 11 can be moved in a stroke direction along a stroke axis 14. The stroke axis 14 runs in the direction of the Z axis of the coordinate system of a numerical controller 15, indicated in FIG. 1, of the machine tool 1. Perpendicularly with respect to the stroke axis 14, the stroke drive apparatus 13 can be moved along a positioning axis 16 in the direction of the double arrow. The positioning axis 16 runs in the direction of the Y direction of the coordinate system of the numerical controller 15. The stroke drive apparatus 13, which receives the upper tool 11, is moved along the positioning axis 16 by means of a motor drive 17.

The movement of the plunger 12 along the stroke axis 14 and the positioning of the stroke drive apparatus 13 along the positioning axis 16 are performed by means of a motor drive arrangement 17, in particular a spindle drive arrangement, with a drive spindle 18 which runs in the direction of the positioning axis 16 and which is fixedly connected to the machine frame 2. During movements along the positioning axis 16, the stroke drive apparatus 13 is guided on three guide rails 19 of the upper frame member 3, of which two guide rails 19 can be seen in FIG. 1. The one remaining guide rail 19 runs parallel to the visible guide rail 19 and is spaced apart from the latter in the direction of the X axis of the coordinate system of the numerical controller 15. Guide shoes 20 of the stroke drive apparatus 13 run on the guide rails 19. The mutual engagement of the guide rail 19 and of the guide shoes 20 is such that this connection between the guide rails 19 and the guide shoes 20 can also accommodate a load acting in a vertical direction. The stroke apparatus 13 is accordingly suspended on the machine frame 2 by means of the guide shoes 20 and the guide rails 19. A further part of the stroke drive apparatus 13 is a wedge mechanism 21 by means of which a situation of the upper tool 11 relative to the lower tool 9 is adjustable.

The lower tool 9 is received so as to be movable along a lower positioning axis 25. This lower positioning axis 25 runs in the direction of the Y axis of the coordinate system of the numerical controller 15. The lower positioning axis 25 is preferably oriented parallel to the upper positioning axis 16. The lower tool 9 can, directly at the lower positioning axis 25, be moved along the positioning axis 16 by means of a motor drive arrangement 26. Alternatively, or in addition, the lower tool 9 may also be provided on a stroke drive apparatus 27, which is movable along the lower positioning axis 25 by means of the motor drive arrangement 26. This drive arrangement 26 is preferably configured as a spindle drive arrangement. The lower stroke drive apparatus 27 may correspond in terms of construction to the upper stroke drive apparatus 13. The motor drive arrangement 26 may likewise correspond to the motor drive arrangement 17.

The lower stroke drive apparatus 27 is likewise displaceably mounted on guide rails 19, which are assigned to a lower horizontal frame member 4. Guide shoes 20 of the stroke drive apparatus 27 run on the guide rails 19 such that the connection between the guide rails 19 and guide shoes 20 on the lower tool 9 can also accommodate a load acting in a vertical direction. Accordingly, the stroke drive apparatus 27 is also suspended on the machine frame 2 by means of the guide shoes 20 and the guide rails 19 and so as to be spaced apart from the guide rails 19 and guide shoes 20 of the upper stroke drive apparatus 13. The stroke drive apparatus 27 may also comprise a wedge mechanism 21 by means of which the situation or height of the lower tool 9 along the Z axis is adjustable.

Figure 2:
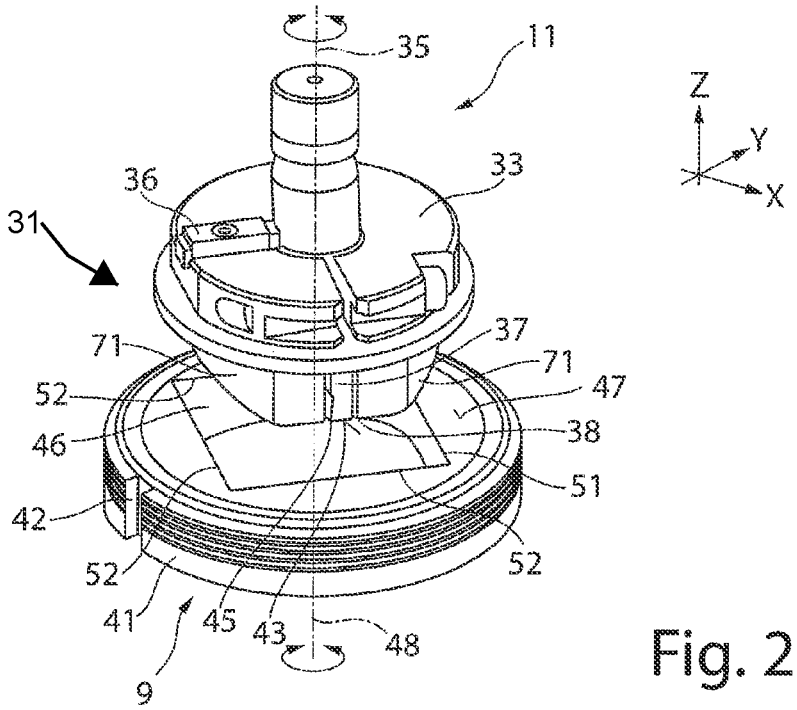
FIG. 2 shows a perspective view of a tool for a machine tool as per FIG. 1.
Figure 3:
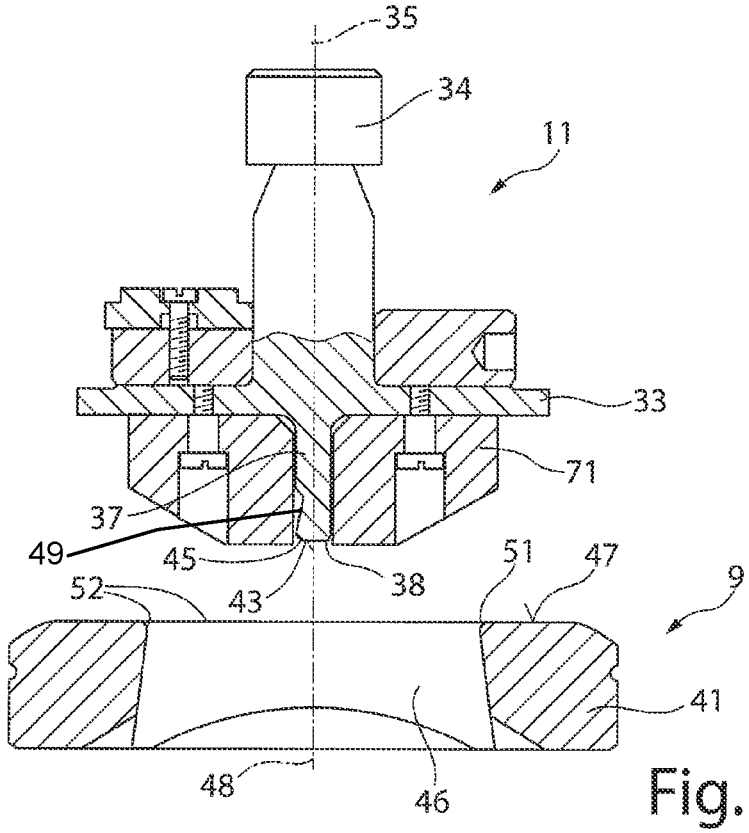
FIG. 3 shows a schematic sectional view of the tool as per FIG. 2.

FIG. 2 is a perspective illustration of a tool 31 and FIG. 3 shows a schematic sectional view taken through the tool 31 of FIG. 2. The tool 31 is configured as a bending and punching tool. The tool 31 comprises a bending and punching ram, which forms the upper tool 11, and a bending and punching die, which forms the lower tool 9. The upper tool 11 comprises a main body 33 with a clamping shank 34 and an alignment or indexing element or an alignment or indexing wedge 36. The clamping shank 34 serves for the fixing of the upper tool 11 in the machine-side upper tool receptacle. Here, the orientation of the upper tool 11 or the rotational position of the upper tool 11 is determined by the indexing wedge 36. Here, the upper tool 11 is rotated about a position axis 35. The position axis 35 forms a longitudinal axis of the clamping shank 34 and preferably also a longitudinal axis of the main body 33. The adoption of the rotational position of the upper tool 11 in the upper tool receptacle results in an orientation of a processing tool 37 of the upper tool.

The lower tool 9 likewise comprises a main body 41, which is suitable for being fixed in the machine-side lower tool receptacle with a defined rotational position, for example by means of at least one indexing element 42. Here, the lower tool 9 is rotatable about a position axis 48. This forms a longitudinal axis or longitudinal central axis of the main body 41.

In the main body 41, the lower tool 9 has an opening 46, which is preferably delimited by an encircling bearing surface 47. The opening 46 preferably extends all the way through the main body 41, such that workpiece parts 81 that have been punched out or cut away can be discharged through the opening.

The processing tool 37 on the upper tool 11 comprises at least one cutting edge 38 and at least one bending edge 45. At the end side, the processing tool 37 has a ram surface 43. The ram surface 43 is delimited in one direction by the cutting edge 38 and in an opposite direction by a bending edge 45. The cutting edge 38 and the bending edge 45 are preferably oriented parallel to one another. The cutting edge 38 and bending edge 45 preferably lie in a common plane at right angles with respect to the positioning axis 35. The ram surface 43 delimits the body of the processing tool 37 with an elongate rectangular geometry.

The bending edge 45 is adjoined at one side by the ram surface 43 and at the other side by an inclined surface 49. The inclined surface 49 is configured so as to be at an angle of less than 90° with respect to the ram surface 43. A bend radius 45 of the bending edge may be selected in accordance with the bend radii to be produced.

The lower tool 9, which for example comprises the opening 46, has an internally situated counterpart cutting edge 51 adjoining the bearing surface 47. The opening 46 is preferably of square or rectangular form. At least one further side edge of the opening 46 may be configured as a counterpart bending edge 52. It is preferable for one counterpart cutting edge 51 and two or more counterpart bending edges 52 to be provided, wherein the further counterpart bending edges 52 may in each case have different radii than one another. Aside from a square or rectangular opening, use may also be made of an opening in the shape of a polygon in order to be able to use further counterpart cutting or counterpart bending edges. Increased flexibility of the tool 31 can thus be realized. One or more further counterpart cutting edges may also be provided, which can be used if a first counterpart cutting edge has become unusable for example as a result of wear.

A punching-out surface 56 is provided so as to adjoin the internally situated counterpart cutting edge 51, which punching-out surface is configured so as to be parallel to the longitudinal axis 40 of the tool body 39, or so as to be inclined slightly relative to the longitudinal axis, in order to allow the workpiece part 81 to be cut from the workpiece 10 with high cut quality.

A hold-down element 71 is provided in each case laterally adjacent to the processing tool 39. The hold-down element 71 is preferably provided exchangeably on the main body 33 of the upper tool 11. The hold-down elements 71 are elastically flexible. Thermoplastic elastomers, in particular PU, are preferably used for forming the hold-down elements 71. Further resiliently elastic materials, in particular resiliently elastic materials which are suitable for the processing of plate-like material even with the use of lubricants or oils, may be provided. The hold-down elements 71 preferably have an end surface 72. The end surface 72 is preferably oriented parallel to the ram surface 43. The lateral spacing of the hold-down elements 71 to the processing tool 37 is dimensioned such that, when the hold-down elements 71 lie on the lower tool 9, a compression of the hold-down elements 71 is made possible, wherein a plunging depth of the processing tool 37 can still be effected such that the processing tool 37, in particular the bending edge 45, can also be adjusted relative to the counterpart bending edge 52 on the lower tool 9 so as to generate overbending on the workpiece part 81.

Figure 4:
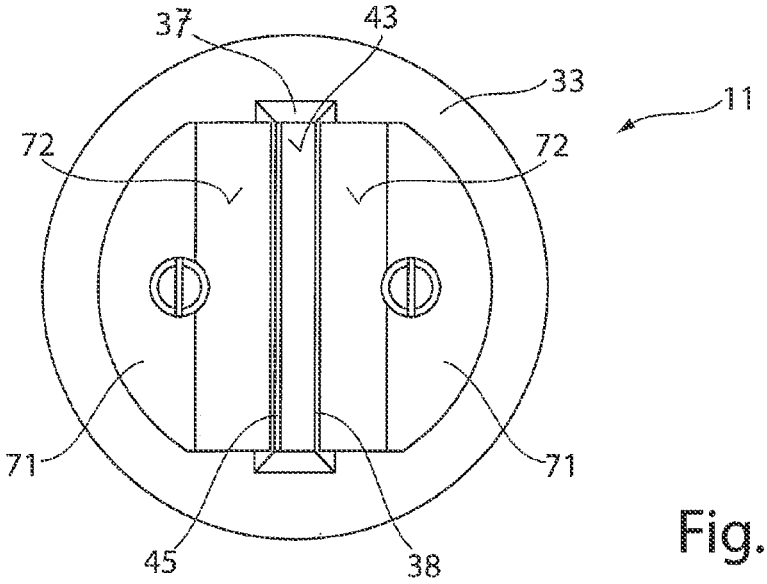
FIG. 4 shows a schematic view from below of the upper tool as per FIG. 2.

FIG. 4 illustrates a view from below of the upper tool as per FIG. 2. The length of the hold-down elements 71 corresponds to the length of the processing tool 37. The length of the hold-down elements 71 may be greater than the length of the processing tool 37, such that the end surfaces 72 of the hold-down elements 71 project relative to the ram surface 43. Alternatively, the length of the hold-down element 71 may also be shorter than the length of the processing tool 37.

In some usage situations, the length of the hold-down element 71 is equal to the length of the processing tool 37.

Figure 5:
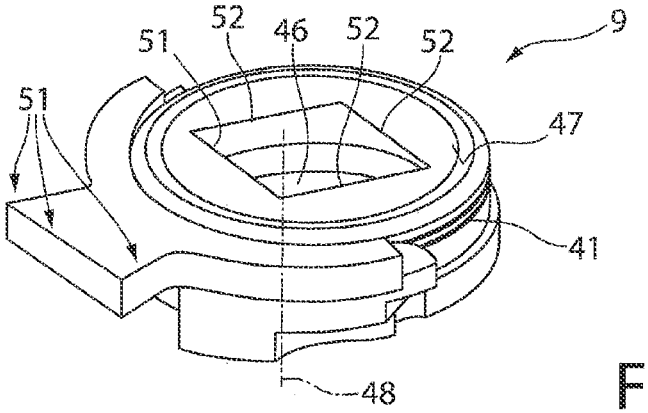
FIG. 5 shows an alternative embodiment of the lower tool in relation to the lower tool as per FIG. 2.

FIG. 5 illustrates a perspective view of an alternative embodiment of the lower tool 9 in relation to FIG. 2. In this embodiment, it is for example the case that a counterpart cutting edge 51 is provided outside the bearing surface 47 on the main body 41 of the lower tool 9. This counterpart cutting edge 51 may, on a separate component, be connected preferably by means of a screw connection to the lower tool 9. This arrangement allows the counterpart cutting edge 51 to be configured to be of greater width than the counterpart cutting edge 51 in the opening 46, which is delimited by the outer periphery of the bearing surface 47. Alternatively, analogously to the counterpart cutting edge 51, the counterpart bending edge 52 may likewise be provided outside the bearing surface 47. For example, such a counterpart bending edge 52 could be oriented oppositely to the counterpart cutting edge 51 in relation to the main body 41. If the counterpart cutting edge 51 and/or counterpart bending edge 52 are provided outside the bearing surface 47 of the lower tool 9, the opening 46 can be omitted. The opening 46 may preferably also be configured with at least one counterpart cutting edge 51 and at least one counterpart bending edge 52 even if at least one externally situated counterpart cutting edge 51 and/or counterpart bending edge 52 is provided. Wider workpiece parts 81 can be bent at an angle and cut off by means of the counterpart cutting edge 51 and/or counterpart bending edge 52 arranged outside the bearing surface 47 than by means of the counterpart cutting edge 51 and/or counterpart bending edge 52 provided in the opening 46.

Figure 6:
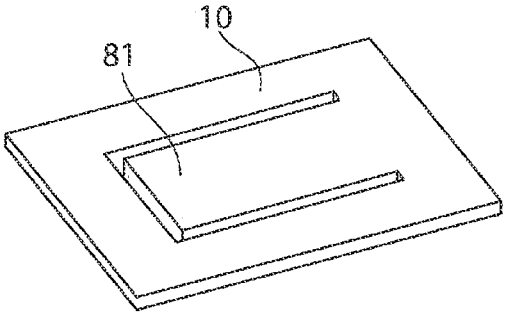
FIG. 6 shows a schematic view of a plate-like workpiece that has been prepared for processing using the tool as per FIG. 2.

FIG. 6 illustrates a simplified perspective view of a plate-like workpiece 10, which comprises a workpiece part 81. The workpiece part 81 is illustrated, by way of example, as a tab-like cut-out portion. The workpiece 10 may be produced by laser cutting and/or by means of a punching processing operation in a preparatory processing step, in order for the workpiece part 81 to subsequently be processed by bending and/or punching. Here, the workpiece part 81 may be formed as a good part. Alternatively, the workpiece part 81 may also constitute a waste part, such that the plate-like workpiece 10 is present in the form of a semifinished part or finished workpiece.

Figure 7:
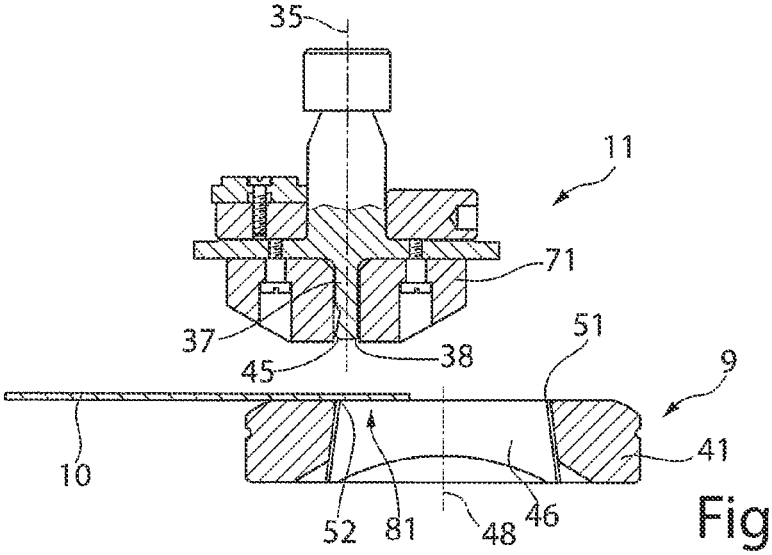
FIGS. 7 to 9 show schematic side views for illustrating an operation of pivoting and bending processing of the workpiece part as per FIG. 6 using the tool as per FIG. 2.
Figure 8:
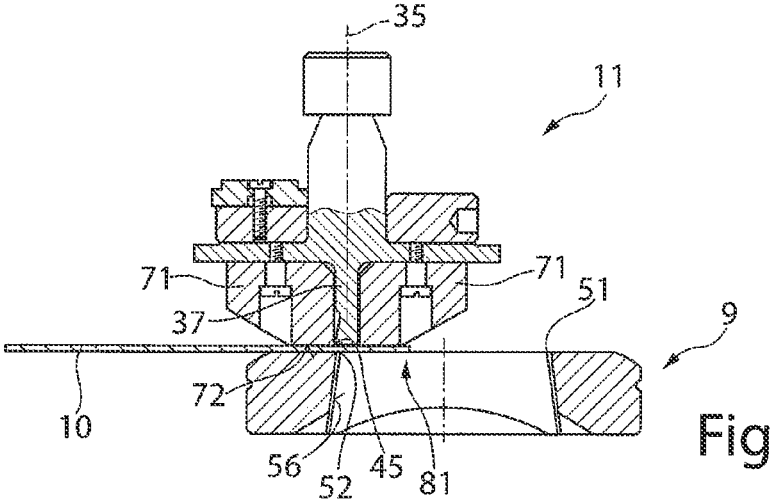
Figure 9:
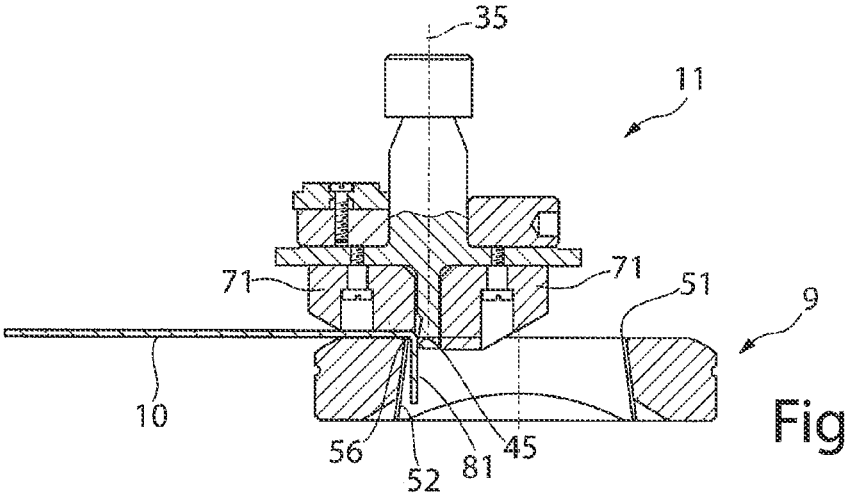

FIGS. 7 to 9 illustrate a bending and punching processing operation in individual steps using the tool 31. FIG. 7 shows the upper tool 11 in an initial position relative to the lower tool 9, which is illustrated in a sectional view. The workpiece 10 lies on the bearing surface 47 of the lower tool 9. Here, the workpiece part 81 is aligned for the subsequent processing step, that is to say the length of the workpiece part 81 or of the tab-like cut-out portion is aligned with the counterpart bending edge 52 on the lower tool 49, such that the workpiece part 81 is deformed by means of angling or an angled bend 62.

In a first working step, the upper tool 11 is moved along the stroke axis 14 or the position axis 35 toward the lower tool 9. The ram surface 43 lies on the workpiece part 81. At the same time, the end surfaces 72 of the hold-down element 71 lie on the workpiece part 81 and/or on the workpiece 10 and fix this relative to the bearing surface 47 of the lower tool 9 (FIG. 8). During a further stroke movement, as illustrated in FIG. 9, the bending edge 45 is moved past the counterpart bending edge 52, whereby a first deformation of the workpiece part 81 is performed. The stroke movement of the upper tool 11 may be continued further in order to transfer the processing tool 37 into the position illustrated in FIG. 9. It is alternatively also possible for a return stroke of the upper tool 11 to be effected again, in order for a further stroke movement toward the lower tool 9 to subsequently be effected, wherein the spacing of the positioning axes 35 and 48 can thereby also be varied. This is dependent on the radius that is to be formed for the angled bend 62.

During a stroke movement as per FIG. 9, the angled bend 62 can be bent further, such that an angle of 90° is formed between the workpiece 10 and the workpiece part 81.

If the workpiece part 81 is intended to exhibit overbending in relation to the workpiece 10, that is to say if it is the intention to initially set a bend angle of greater than 90°, a lateral displacement movement, in particular in a Y direction, is additionally superposed on the stroke movement of the upper tool 10. It is also possible for a displacement movement of the lower tool 9 along the lower positioning axis 25 to be effected exclusively or in addition. By means of the inclined surface 49 on the processing tool 37, the bending edge 45 can engage behind the counterpart bending edge 52, and the overbending can thus be achieved. This may be performed to such a degree that, after the processing tool 37 is moved out of the opening 46 of the lower tool 9, the angled bend 62 springs back to an angle of 90°.

Figure 10:
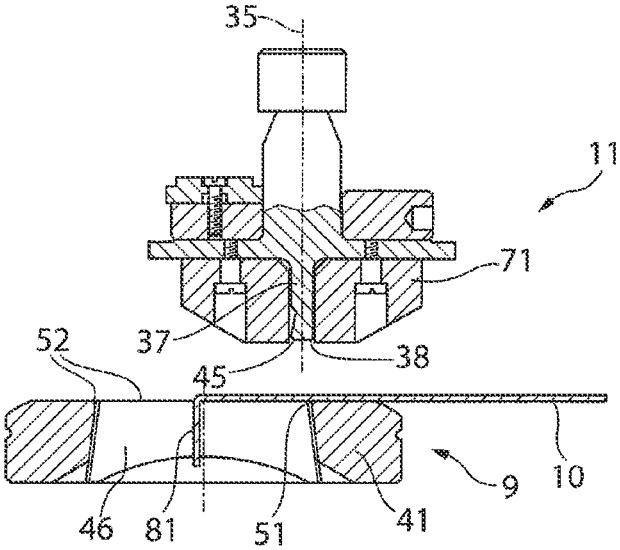
FIGS. 10 to 12 show schematic side views for illustrating an operation of punching processing of a workpiece part that has been processed in accordance with FIGS. 7 to 9.
Figure 11:
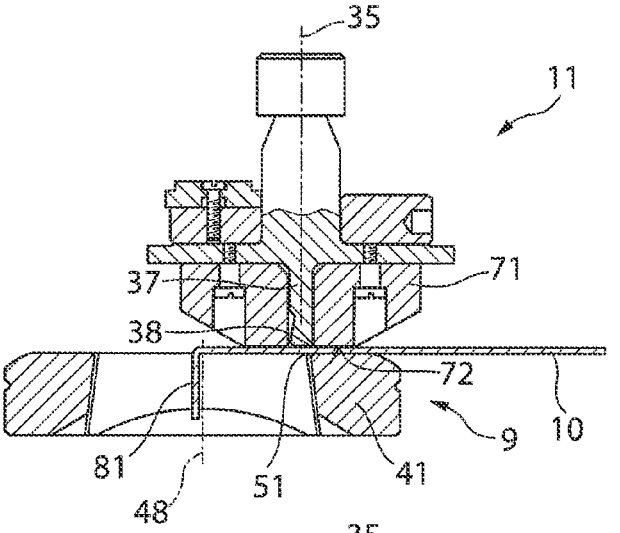
Figure 12:
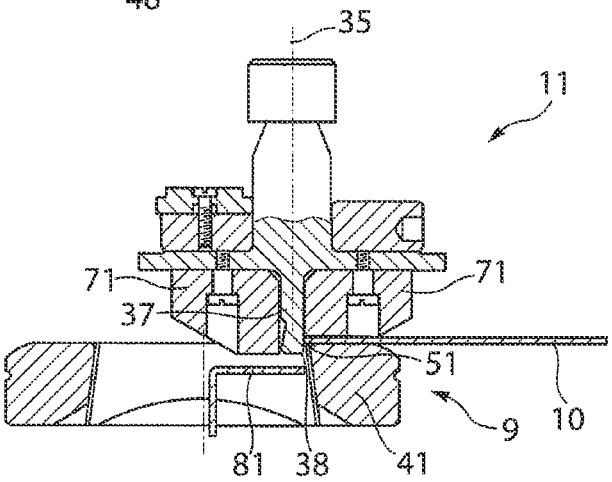

Subsequently, for example, a cutting stroke is effected, which is illustrated in FIGS. 10 to 12. Here, proceeding from the bending position as per FIG. 9, a displacement movement is effected in order to position the upper tool 11 with a spacing above the lower tool 9. Subsequently or at the same time, a rotational movement of the lower tool 9 is effected such that a counterpart cutting edge 51 of the opening 46 is aligned with the cutting point of the workpiece part 81. The workpiece 10 may additionally also be displaced in the X/Y plane into the position for the cutting stroke. The upper tool 11 may remain in its position, or a displacement movement may be effected such that the cutting edge 38 is aligned with the counterpart cutting edge 51 of the lower tool 9. This rotation of the upper and/or lower tool 9 is dependent on the number and arrangement of counterpart cutting edges 51 in the opening 46 and/or in the alignment with the workpiece part 81 that is to be cut off. This also applies analogously to the counterpart cutting edge 52, which in the alternative embodiment of the lower tool 9 as per FIG. 5 is situated outside the bearing surface 47. A stroke movement of the upper tool 11 for the cutting stroke is subsequently effected in order to cut the workpiece part 81 by means of the movement of the cutting edge 38 and the counterpart cutting edge 51 past one another. Before the workpiece part 81 is cut off from the workpiece 10, the end surface 72 of the hold-down element 71 preferably lies on the workpiece 10, such that the workpiece 10 is held fixed relative to the bearing surface 47 of the lower tool 9 (FIG. 11). Subsequently, by means of the further stroke movement, the workpiece part 81 is cut from the workpiece 10 because the cutting edge 38 and the counterpart cutting edge 51 are moved past one another, as illustrated in FIG. 12. The workpiece part 81 can be discharged downward through the opening 46 of the lower tool 9. Subsequently, the upper tool 11 and the lower tool 9 are transferred back into an initial position or into a position for a subsequent working step.

Figure 13:
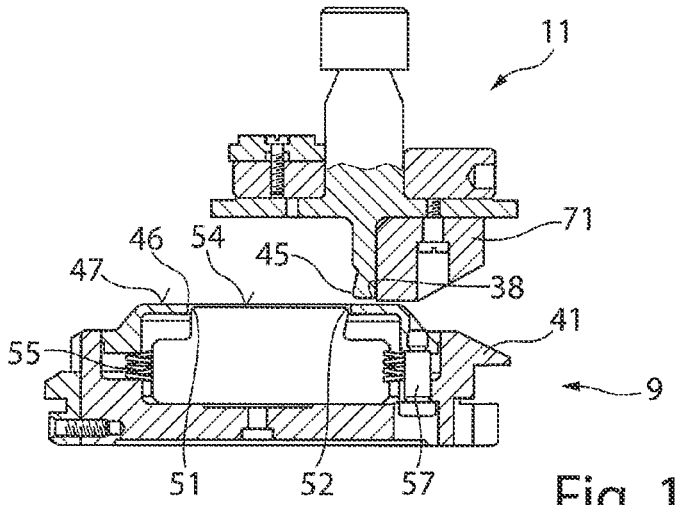
FIG. 13 shows a schematic side view of an alternative embodiment of the tool in relation to FIG. 2 prior to a pivoting and bending processing operation.

FIG. 13 illustrates a schematic side view of an alternative embodiment of the tool 31 in relation to FIG. 2. The upper tool 11 as per FIG. 13 corresponds in terms of construction and embodiment to the upper tool 11 as per FIG. 2, with the exception that only one hold-down element 71 is provided. The hold-down element 71 is preferably assigned to the cutting edge 38. Alternatively, provision may also be made for the hold-down element 71 to be assigned only to the bending edge 45, and for no hold-down element 71 to be positioned relative to the cutting edge 38.

The lower tool 9 as per FIG. 13 is of different configuration than the lower tool 9 as per FIG. 2. The main body 41 receives a base body 53, which is fixedly connected to the main body 41. The counterpart bending edge 52 is provided on the base body 53. A further counterpart bending edge, or, as illustrated in the exemplary embodiment, a counterpart cutting edge 51, may be provided opposite the counterpart bending edge 52. The base body 53 with the counterpart bending edge 52 and/or the counterpart cutting edge 51 may be provided exchangeably on the main body 41. The counterpart bending edge 52 and the counterpart cutting edge 51 are spaced apart from one another by a ram surface 54.

The bearing surface 47 is received on the main body 41 so as to be displaceable counter to the Z direction relative to the counterpart bending edge 52 and counterpart cutting edge 51. The opening 46 is provided in the bearing surface 47, which opening surrounds the ram surface 54. Elastically flexible restoring elements 55 are preferably provided between the bearing surface 47 and the main body 41. After an exertion of load on the bearing surface 47 as a result of a displacement movement toward the main body 41, the bearing surface 42 can be transferred back into the initial position, as illustrated in FIG. 13. It is advantageously possible for guide elements 57 to be provided, by means of which the bearing surface 47 is guided so as to be movable up and down relative to the main body 41. For example, only one guide element is illustrated, wherein it is preferable for several to be provided in a manner distributed uniformly over the circumference.

The upper tool 11 is positioned in an initial position relative to the lower tool 9 before the start of a pivoting and bending movement. This pivoting and bending movement may be performed analogously to that described with regard to FIGS. 7 to 9. Reference is made directly thereto.

Figure 14:
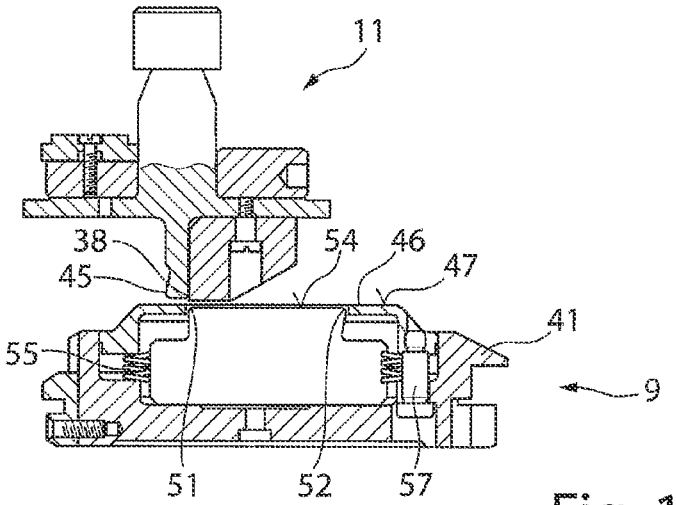
FIG. 14 shows a schematic side view of the alternative embodiment of the tool as per FIG. 13 prior to a punching processing operation.

FIG. 14 illustrates a schematic side view of the tool 31 as per FIG. 13. The upper tool 11 is positioned in an initial position relative to the lower tool 9 for a cutting stroke. For example, this position may be adopted by means of a displacement movement of the upper tool 11 and/or lower tool 9 along the upper positioning axis 16 and/or the lower positioning axis 25. Subsequently, a cutting stroke can be effected for a punching processing operation, as has been described with regard to FIGS. 10 to 12. Reference is made to the description in its entirety.

Figure 15:
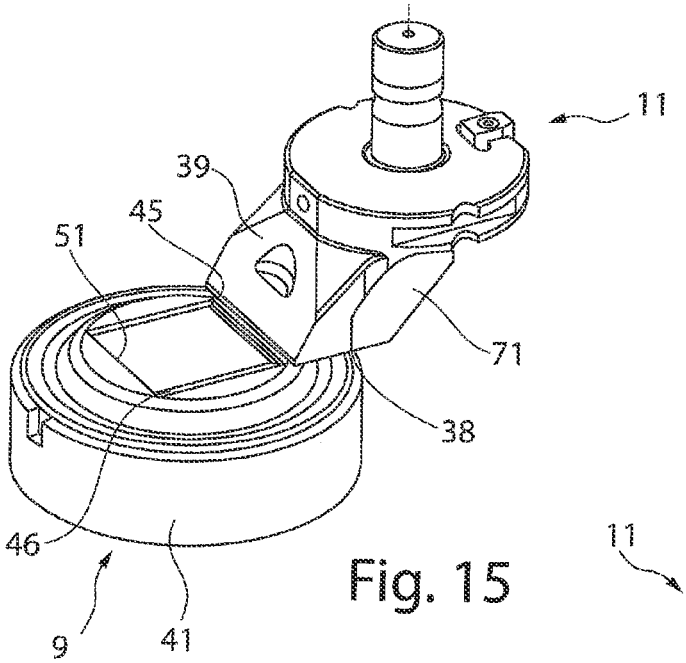
FIG. 15 shows a perspective view of a further alternative embodiment of the tool in relation to FIG. 13.
Figure 16:
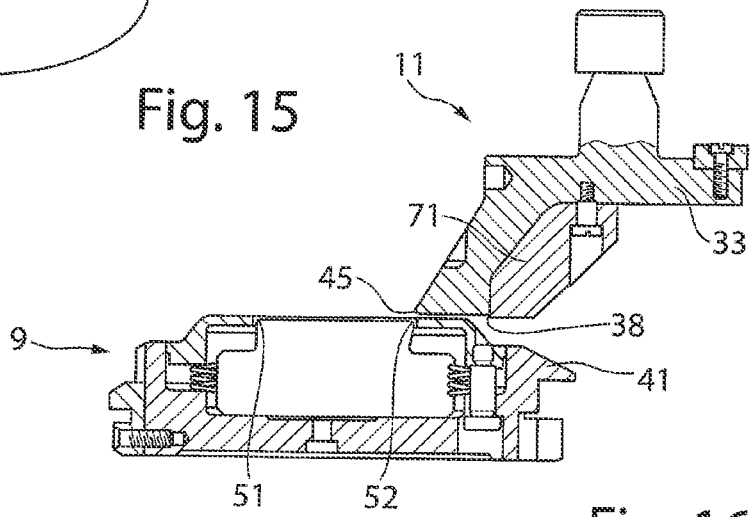
FIG. 16 shows a schematic side view of the tool as per FIG. 15 prior to an operation of pivoting and bending processing of a workpiece part.
Figure 17:
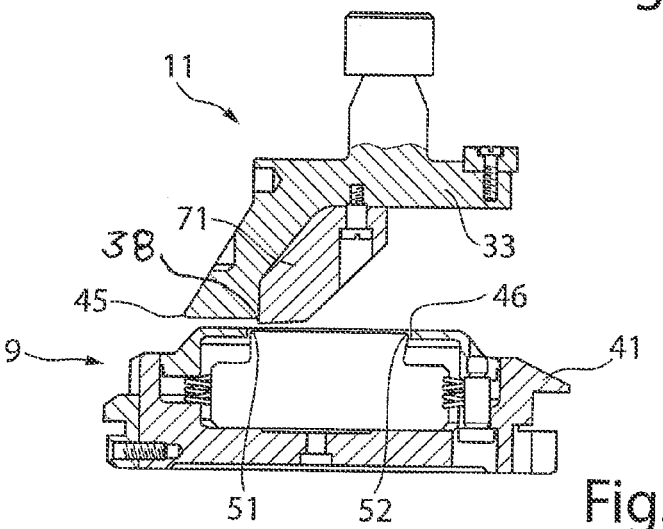
FIG. 17 shows a schematic side view of the tool as per FIG. 15 prior to an operation of punching processing of the workpiece part.

FIG. 15 illustrates a perspective view of an alternative embodiment of the tool 31 in relation to FIGS. 2 and 13. FIG. 16 shows a schematic side view of the tool 31 as per FIG. 15 prior to a pivoting and bending processing operation. FIG. 17 shows a schematic side view of the tool 15 before a cutting stroke.

The tool 31 as per FIG. 15 has a processing tool 37 which comprises both a cutting edge 38 and a bending edge 45. These are preferably oriented parallel to one another and lie in particular in a common plane. A ram surface 43 is formed between the bending edge 45 and the cutting edge 38.

In this embodiment, provision is made for at least the bending edge 45 to lie outside a projection area which is formed perpendicular to the position axis 35 and, as viewed in the stroke direction, by the main body 33. The cutting edge 38 may lie within or outside the projection area. In this embodiment, provision is made for the cutting edge 38 to be assigned a hold-down element 71. The bending edge 45 is provided without the assignment of a hold-down element 71. An end surface 72 of the hold-down element 71 preferably lies in the plane of the ram surface 43. This end surface 72 of the hold-down element 71 may also project slightly in the stroke direction relative to the ram surface 43. The hold-down element 71 is also of elastically flexible form. Further possible configurations of the hold-down element 71 that have been specified with regard to the embodiments described above also apply to this tool 31 as per FIGS. 15 to 17.

The lower tool 9 as per FIGS. 15 to 17 corresponds in terms of construction to the lower tool 9 as per FIGS. 13 to 14, such that reference is made to the description in its entirety.

FIG. 16 illustrates an initial position for a pivoting and bending processing operation of the workpiece 10. The upper tool 11 is aligned with the lower tool 9 such that the bending edge 45 is assigned to the counterpart bending edge 52. After a pivoting and bending processing operation has been performed, the upper tool 11 and/or the lower tool 9 can be displaced relative to one another along the upper positioning axis 16 and/or the lower positioning axis 25, such that the working position in FIG. 17 is adopted. Here, the cutting edge 38 is aligned with the counterpart cutting edge 51 of the lower tool 9. Proceeding from this working position, a cutting stroke can be performed in order to punch out the workpiece part 81 from the workpiece 10, as described in the embodiment as per FIGS. 10 to 12.

The invention claimed is:

1. A tool for processing plate-shaped workpieces, the tool comprising:

an upper tool and a lower tool movably disposed toward one another for processing a workpiece arranged in between said upper and lower tools;

said upper tool having a clamping shank and a main body, arranged on a common position axis, and a processing tool mounted to said main body opposite said clamping shank;

said upper tool being mounted for rotating said processing tool relative to said lower tool about the common position axis;

said lower tool having a main body with a bearing surface for the workpiece and an opening formed within said bearing surface;

said opening having a shape of a polygon with at least one counterpart cutting edge and at least two counterpart bending edges distributed about a circumference of said opening, and said at least two bending edges having different bending radii from one another;

said processing tool of said upper tool being formed with a ram surface that is substantially orthogonal to the common position axis, at least one bending edge disposed for interaction with one of said at least two counterpart bending edges and at least one cutting edge disposed for interaction with said at least one counterpart cutting edge, said bending edge being adjoined by an inclined surface away from said bending edge and towards said common position axis, and said inclined surface enclosing an angle of less than 90° with said ram surface of said processing tool.

2. The tool according to claim 1, wherein said cutting edge and said bending edge of said processing tool are formed separately from one another on said processing tool.

3. The tool according to claim 2, wherein said cutting edge and said bending edge of said processing tool are formed separately from one another on one and the same processing tool.

4. The tool according to claim 1, wherein said cutting edge and said bending edge are arranged on said processing tool so as to be in each case oppositely spaced apart from said position axis.

5. The tool according to claim 1, wherein said cutting edge and said bending edge run parallel to one another and are oriented perpendicular to said position axis.

6. The tool according to claim 1, wherein said cutting edge and said bending edge delimit said ram surface on said processing tool.

7. The tool according to claim 1, wherein said bending edge of said processing tool runs perpendicular to said position axis, and wherein said cutting edge is oriented so as to be spaced apart in parallel from said bending edge but inclined at an angle relative to said position axis.

8. The tool according to claim 1, wherein said processing tool is formed with an inclined surface that extends from said bending edge in a direction of said main body and with an inclination relative to said position axis.

9. The tool according to claim 1, wherein said bending edge and said cutting edge of said upper tool are aligned within a projection plane which is formed perpendicular to said position axis and, as viewed in a stroke direction, through said main body, or wherein at least said bending edge or said cutting edge of said upper tool lie outside said projection plane.

10. The tool according to claim 1, which comprises at least one hold-down element on said main body of said upper tool, said at least one hold-down element extending at least partially along said processing tool and being compressible relative to said processing tool.

11. The tool according to claim 1, wherein said at least two counterpart bending edges and/or said at least one counterpart cutting edge are provided fixed at said opening of said bearing surface or fixedly on a base body of said lower tool, said opening of said bearing surface being positioned so as to adjoin said counterpart bending edge and/or counterpart cutting edge and being displaceable relative to said main body.

12. The tool according to claim 1, wherein a length of said bending edge and/or of said cutting edge on said processing tool is smaller than an opening width of said opening in said bearing surface of said lower tool.

13. The tool according to claim 1 configured for processing plate-shaped metal sheets.

14. A method of processing a plate-shaped workpiece, the method comprising:

providing an upper tool with a processing tool having a ram surface that is substantially orthogonal to a common position axis, at least one bending edge and at least one cutting edge, the bending edge being adjoined by an inclined surface away from the bending edge, towards the common position axis, and with the inclined surface enclosing an angle of less than 90° with the ram surface of the processing tool, and wherein the upper tool is movable by a stroke drive apparatus along a stroke axis in a direction of the workpiece for processing by the upper tool and in an opposite direction, and which is positionable along an upper positioning axis running perpendicular to the stroke axis, and moving the upper tool along the upper positioning axis by a drive arrangement;

providing a lower tool, which is aligned with the upper tool and is positionable along a lower positioning axis which is oriented perpendicular to the stroke axis of the upper tool, and moving the lower tool along the lower positioning axis by a drive arrangement;

actuating the drive arrangements by a controller for selectively moving the upper tool or the lower tool;

positioning a workpiece part of the plate-shaped workpiece relative to a bearing surface of the lower tool;

selecting one of at least two counterpart bending edges in accordance with a given bending radius thereof and aligning the bending edge of the upper tool and the one of the at least two counterpart bending edges of the lower tool with one another, and effecting at least one bending stroke movement during which the workpiece part is bent with the given bending radius and at an angle relative to the plate-shaped workpiece; and transferring the workpiece part that has been bent at an angle and/or the cutting edge of the upper tool and a counterpart cutting edge of the lower tool into a cutting position, and subsequently effecting a cutting stroke for punching out the workpiece part from the plate-shaped workpiece.

15. The method according to claim 14, wherein the step of aligning the bending edge or cutting edge of the upper tool with the one of at least two counterpart bending edges or counterpart cutting edge of the lower tool comprises rotating at least one of the upper tool or the lower tool and/or displacing at least one of the upper tool or the lower tool in a displacement direction along the upper and/or lower positioning axis.

16. The method according to claim 14, which comprises, during the bending stroke movement between the upper tool and the lower tool, performing a stroke movement along the stroke axis of the upper tool and/or of the lower tool, or additionally superposing a stroke movement that lies outside the stroke axes on the stroke movement along the stroke axes.

17. The method according to claim 14, wherein, when a width of the workpiece part is smaller than the opening in the bearing surface of the lower tool, adjusting at least one of the bending or cutting position relative to the one of at least two counterpart bending edges and/or counterpart cutting edges to lie inside the opening.

18. The method according to claim 14, wherein, when a width of the workpiece part is greater than the opening in the bearing surface of the lower tool, adjusting at least one of the bending or cutting position to the one of at least two counterpart bending edges and/or counterpart cutting edge to lie outside the bearing surface.

19. The method according to claim 14, wherein the aligning step comprises, for a cutting stroke or for a bending stroke, aligning the cutting edge or the bending edge of the upper tool and the counterpart cutting edge or the one of at least two counterpart bending edges of the lower tool in dependence on a material thickness of the workpiece part.

* * * * *